US007464763B2

(12) United States Patent
Galloway et al.

(10) Patent No.: US 7,464,763 B2
(45) Date of Patent: Dec. 16, 2008

(54) METHOD OF INJECTING LIFT GAS AND GAS LIFT FLOW CONTROL DEVICE

(75) Inventors: Arthur William Galloway, Missouri City, TX (US); James William Hall, Rijswijk (NL); Joseph Larry Johnson, Lafayette, LA (US); Gary Nettleship, Subiaco (AU)

(73) Assignee: Shell Oil Company, Houston, TX (US)

( * ) Notice: Subject to any disclaimer, the term of this patent is extended or adjusted under 35 U.S.C. 154(b) by 110 days.

(21) Appl. No.: 10/593,734

(22) PCT Filed: Mar. 21, 2005

(86) PCT No.: PCT/EP2005/051298

§ 371 (c)(1), (2), (4) Date: Sep. 20, 2006

(87) PCT Pub. No.: WO2005/093209

PCT Pub. Date: Oct. 6, 2005

(65) Prior Publication Data

US 2008/0121397 A1 May 29, 2008

(30) Foreign Application Priority Data

Mar. 22, 2004 (EP) ..... 04101175

(51) Int. Cl.
*E21B 43/00* (2006.01)

(52) U.S. Cl. ..... 166/372; 166/332.8

(58) Field of Classification Search ..... 166/372, 166/332.8, 319, 321

See application file for complete search history.

(56) References Cited

U.S. PATENT DOCUMENTS 4,248,308 A 2/1981 Pringle ..... 166/322

(Continued)

FOREIGN PATENT DOCUMENTS

WO 1999053170 10/1999

OTHER PUBLICATIONS

ISR Report dated Sep. 6, 2005 (PCT/EP2005/051298).

*Primary Examiner*—Jennifer H Gay
*Assistant Examiner*—Brad Harcourt

(57) ABSTRACT

A method is disclosed for injecting lift gas or other fluid into a production conduit of an oil well via one or more wear resistant downhole gas lift flow control devices which each comprise: a tubular valve housing (1) comprising a flow passage (2) having an upstream end (9) which is connected to a lift gas supply conduit and a downstream end (10) which is connected to the interior of the production conduit; a flapper type valve body (3) which is pivotally connected to the valve housing (1) and is arranged in the flow passage (2) such that if the valve body is pivoted in the open position the valve body is oriented substantially parallel to the flow passage and that if the valve body is pivoted in the closed position the valve body is oriented substantially perpendicular to the flow passage and is pressed against a ring shaped valve seat (4), thereby blocking passage of lift gas through the flow passage (2); a valve protection sleeve (5) which is slidably arranged in the flow passage (2) between a first position (shown in FIG. 2) wherein the sleeve (5) extends through the ring-shaped valve seat, whilst the valve body (3) is pivoted in the open position thereof, thereby protecting the valve body and seat against wear by the flux of lift gas or other fluid and a second position (shown in FIG. 1) wherein the sleeve (5) extends through the section of the flow passage (2) upstream of the valve seat (4), whilst the valve body (3) is pivoted in the closed position thereof; and a flow restrictor (8) forming part of the valve protection sleeve (5), which is dimensioned such that the flux of lift gas flowing through the flow restrictor (8) creates a pressure difference which induces the sleeve (5) to move towards the first position.

12 Claims, 1 Drawing Sheet

U.S. PATENT DOCUMENTS 4,427,071 A * 1/1984 Carmody ..... 166/332.8
4,901,798 A * 2/1990 Amani ..... 166/311
5,004,007 A * 4/1991 Johnson et al. ..... 137/501
5,257,663 A 11/1993 Pringle et al. ..... 166/66.4
5,535,828 A 7/1996 der Kinderen et al. ..... 166/372

* cited by examiner

METHOD OF INJECTING LIFT GAS AND GAS LIFT FLOW CONTROL DEVICE

PRIORITY CLAIM

The present application claims priority on European Patent Application 04101175.0 filed 22 Mar. 2004.

FIELD OF THE INVENTION

The invention relates to a method of injecting lift gas into a production conduit of an oil well via one or more gas lift flow control devices and to a gas lift flow control device for use in the method.

BACKGROUND OF THE INVENTION

It is common practice to pump lift gas into the annulus between a production tubing and surrounding well casing and to pump the lift gas subsequently into the production tubing from the annulus via one or more one way gas lift flow control devices in side pockets that are distributed along the length of the production tubing. The lift gas which is injected through the flow control devices into the crude oil (or other fluid) stream in the production conduit reduces the density of the fluid column in the production conduit and enhances the crude oil production rate of the well.

Commercially available gas lift flow control devices typically use one way check valves which comprise a ball or hemisphere or cone which is pressed against a valve seating ring by a spring. If the lift gas pressure is higher than the pressure of the crude oil stream in the production conduit then this pressure difference exceeds the forces exerted to the ball by the spring so that the spring is compressed and the ball is lifted, or moved away, from the valve seating ring and lift gas is permitted to flow from the gas filled injection conduit into the production conduit. If however the pressure of the crude oil stream is higher than the lift gas pressure in the injection conduit, the accumulated forces of the spring and the pressure difference across the gas lift flow control device push the ball or hemisphere against the ring shaped seat, thereby closing the check valve and preventing crude oil, or other fluid, to flow from the production conduit into the injection conduit.

A problem with the known check valves is that the ball or hemisphere and ring-shaped valve seat are exposed to the flux of lift gas, which may contain liquids or sand or other abrasive particles and/or corrosive chemical components, such as hydrogen sulfide and carbon dioxide. The ball or hemisphere and valve seat are therefore subject to mechanical and chemical erosion, which may result in leakage of the valve, so that crude oil or other fluids may flow into the injection conduit from the production conduit, and may block further lift gas injection when the crude oil, or other fluid, level in the injection conduit has reached the location of the gas lift flow control device or flow control devices.

U.S. Pat. No. 5,535,828 discloses a surface controlled gas lift valve which is retrievably inserted in a side pocket in the production tubing of an oil well, wherein a frustoconical valve body is mounted on a hydraulically actuated piston which can be actuated from surface to press the valve body against a frustoconical valve seat and to lift the valve body from the valve seat. The valve body and valve seat are exposed to the flux of lift gas and subject to mechanical and chemical erosion.

It is known from U.S. Pat. No. 5,004,007 to provide a surface controlled chemical injection valve, wherein a flapper type valve body and associated ring-shaped valve seat are protected from exposure to the flux of injected chemicals by a protective sleeve that is pushed by hydraulic pressure through the ring-shaped valve seat and which is pushed back by a spring once the hydraulic pressure has decreased below a threshold level, thereby permitting the flapper type valve body to swing against the ring-shaped valve seat. The known chemical injection valve is equipped with a flow restriction connected to the valve housing and a piston, which is actuated by the pressure difference across the flow restriction. The piston is arranged in a cylindrical cavity in the valve housing adjacent to the sleeve and is connected to the sleeve. The piston serves to overcome frictional forces between the sleeve and any seals between the sleeve and valve housing and the presence of the piston adjacent to the sleeve makes the valve complex, expensive and prone to failure if contaminants, sand or abrasive particles accumulate in the cylindrical cavity above the piston, and/or if the seals fail.

The complex design of the surface controlled chemical injection valve renders it unsuitable to replace the known wear prone spring actuated ball valves.

SUMMARY OF THE INVENTION

In accordance with the invention there is provided a method of injecting lift gas into a production conduit of an oil well via one or more downhole gas lift flow control devices which each comprise:

- a tubular valve housing comprising a flow passage having an upstream end which is connected to a lift gas supply conduit and a downstream end which is connected to the interior of the production conduit;
- a flapper type valve body which is pivotally connected to the valve housing and is arranged in the flow passage such that if the valve body is pivoted in the open position the valve body is oriented substantially parallel to the flow passage and that if the valve body is pivoted in the closed position the valve body is oriented substantially perpendicular to the flow passage and is pressed against a ring shaped valve seat, thereby blocking passage of fluids through the flow passage;
- a valve protection sleeve which is slidably arranged in the flow passage between a first position wherein the sleeve extends through the ring-shaped valve seat, whilst the valve body is pivoted in the open position thereof, thereby protecting the valve seat and valve body against wear by the flux of lift gas or other fluids and a second position wherein the sleeve extends through the section of the flow passage upstream of the valve seat, whilst the valve body is pivoted in the closed position thereof; and
- a flow restrictor forming part of the valve protection sleeve, which is dimensioned such that the flux of lift gas or other fluids flowing through the flow restrictor creates a difference in pressure which induces the sleeve to move towards the first position.

The invention also relates to a gas lift flow control device for injecting lift gas or other fluids into a production conduit of an oil well, comprising:

- a tubular valve housing comprising a flow passage having an upstream end which is configured to be connected to a lift gas supply conduit and a downstream end which is configured to be connected to the interior of the production conduit;
- a flapper type valve body which is pivotally connected to the valve housing and is arranged in the flow passage such that if the valve body is pivoted in the open position the valve body is oriented substantially parallel to the flow passage and that if the valve body is pivoted in the closed position the valve body is oriented substantially perpendicular to the flow passage and is pressed against a ring shaped valve seat, thereby blocking passage of fluids through the flow passage;

a valve protection sleeve which is slidably arranged in the flow passage between a first position wherein the sleeve extends through the ring-shaped valve seat, whilst the valve body is pivoted in the open position thereof, thereby protecting the valve seat and valve body against wear by the flux of lift gas or other fluids and a second position wherein the sleeve extends through the section of the flow passage upstream of the valve seat, whilst the valve body is pivoted in the closed position thereof; and a flow restrictor forming part of the valve protection sleeve, which is dimensioned such that the flux of lift gas or other fluids flowing through the flow restrictor creates a difference in pressure which induces the sleeve to move towards the first position.

These and other features, advantages and embodiments of the gas lift method and flow control device according to the invention are described in more detail in the accompanying claims, abstract and detailed description with reference to the accompanying drawings.

DETAILED DESCRIPTION OF A PREFERRED EMBODIMENT

Figure 1:
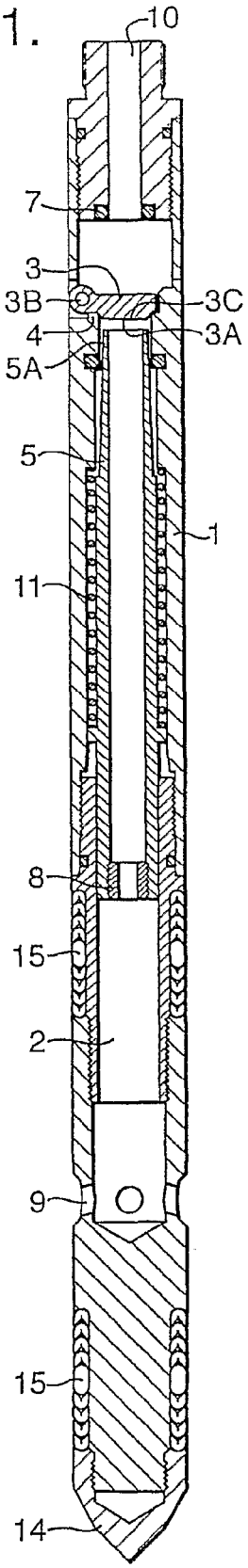
FIG. 1 is a longitudinal sectional view of a flow control device according to the invention wherein the flapper valve body is in the open position and the valve protection sleeve is in the second position.
Figure 2:
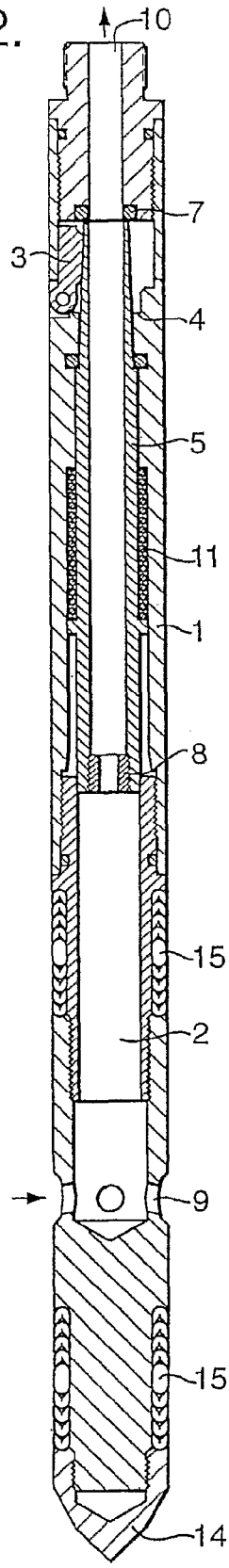
FIG. 2 is a longitudinal sectional view of the flow control device of FIG. 1, wherein the flapper valve body is in the closed position and the valve protection sleeve is in the first position.

FIG. 1 shows a gas lift flow control device comprising a tubular valve housing 1 comprising a longitudinal flow passage 2 in which a flapper type valve body 3 is pivotally arranged such that the valve body 3 can be pivoted between a closed position in which the valve body 3 is pressed against a ring-shaped valve seat 4 as shown in FIG. 1 and an open position in which the valve body 3 is oriented parallel to the flow passage 2 as shown in FIG. 2.

A valve protection sleeve 5 is slidably arranged in the valve housing 1 between a first position shown in FIG. 2 and a second position, which is shown in FIG. 1.

In the first position shown in FIG. 2 the valve is open and the pressure difference across a flow restriction 8 which is mounted inside the sleeve 5 pushes the sleeve 5 up such that the sleeve is pressed against a first and second sealing ring 6 and 7. The pressure difference is caused by the flux of lift gas or other fluids which enters the valve housing via a series of inlet ports 9 and flows up through the flow passage 2 towards a valve outlet opening 10 at the top of the valve, thereby lifting the sleeve 5 up against the action of a spring 11.

In the second position shown in FIG. 1 no lift gas is injected into the flow passage 2, so that there is no pressure difference across the flow restriction 8 and the spring 11 pushes the sleeve 5 down such that the top of the sleeve 5 is below the ring-shaped flapper valve seat 4. The downward movement of the sleeve 5 into the second position permits the flapper valve body 3 to pivot down against the ring-shaped valve seat 4.

In addition to the spring 11 which serves to move the sleeve 5 into the second position any reverse flow of fluids through the sleeve 11 creates a pressure difference which also exerts force in the direction of moving the sleeve 11 to the second (closed) position. The valve protection sleeve 5 has a tapered upper part, of which the taper angle is selected such that the sleeve 11 is centralized as it moves toward the first position and that if the sleeve is in the first position shown in FIG. 2 the conical outer surface of the sleeve 5 firmly engages the first elastomeric sealing ring 6. The first and second sealing rings 6 and 7 thereby define a sealed annular recess 12 in which the flapper body 3 and ring-shaped valve seat 4 are protected from mechanical and/or chemical erosion stemming from the flow of lift gas through the flow passage 2. When lift gas injection is interrupted the spring 11 pushes the sleeve 5 down and the first sealing ring only loosely engages the tapered outer surface of the valve protection sleeve 5, so that the sleeve smoothly slides towards the second position thereof under the action of the spring tension and its own weight, without requiring additional hydraulic action by means of an additional piston as disclosed in U.S. Pat. No. 5,004,007.

Instead of providing the sleeve with a tapered top and mounting the second sealing ring 6 in a recess in the inner wall of the valve housing 1, the second sealing ring 6 could be installed in a recess in the outer wall of a cylindrical sleeve 5, which is surrounded by a tapered section of the valve housing 1.

The valve housing 1 comprises a conical nose section 14 and a series of sealing rings 15 which enable retrievable installation of the valve in a side pocket in a production tubing in the manner as disclosed in U.S. Pat. No. 5,535,828, such that the inlet ports 9 are connected in fluid communication with the annular space between the production tubing and surrounding well casing, into which space the lift gas is injected from surface, and such that the valve outlet opening 10 discharges the lift gas into the crude oil stream in the production tubing.

The valve outlet opening 10 may comprise a plurality of small gas injection ports or a porous membrane as disclosed in International patent application WO 0183944 though which the lift gas is injected as a stream of finely dispersed bubbles into the crude oil stream, thereby creating a foam or froth type mixture of lift gas and crude oil.

The plane of the tilted face 3A of the flapper 3 is not parallel to the plane of the sealing surface of the flapper. The sealing surface of the flapper is designed to fully and simultaneously contact the entire seal surface or valve seat 4 which exists in the body of the flow control device. The sealing face of the flapper and the sealing face in the body of the flow control device are perpendicular to the centerline of the sleeve 5 and are parallel to the face of the sleeve. Since the plane of the tilted face 3A of the flapper 3 is not parallel to the face 5A of the sleeve 5, when the sleeve 5 moves from the second position to the first position, the sleeve 5 contacts one portion of the face 3A of the flapper 3 before it contacts another. The tilted face 3A of the flapper is dimensioned such that the point 3C of initial contact by the sleeve when moving from the second position to the first position is a point 3C farthest away from the hinge pin 3B of the flapper 3. This results in less strain on the hinge pin 3B, resulting in longer life and reduced failures due to hinge pin stress and strain.

The angles of the inlet holes 9 are dimensioned such that the incoming fluids are introduced into the interior 2 of the flow control device with a minimum of abrupt changes of direction. This minimization of direction changes enables the flow control device to cause more lift gas or other fluids to flow through the flow control device with the same flowing condition as other flow control devices which do not allow for flow with a minimum of flow direction changes. Additionally, the reduction of direction changes of the inflowing fluid reduces the erosion on the flow control device surfaces due to reduced turbulence.

Preferably, the sleeve has a tapered section where the outer diameter of the sleeve is gradually reduced in downstream direction of the sleeve and a first flexible sealing ring is arranged in the housing upstream of the valve seat, such that the outer surface of the tapered section of the sleeve is pressed against the inner surface of the sealing ring when the sleeve is in the first position thereof, thereby providing a fluid tight seal in the annular space between the tapered section of the sleeve and the tubular valve housing when the sleeve is in the first position thereof and such that said first sealing ring only loosely engages the tapered section of the sleeve when the sleeve is in the second position thereof.

The tapered section also serves to centralize the sleeve in the valve body as it moves to the first position from the second position.

Alternatively, the tubular valve housing has a tapered section where the inner diameter of the housing is gradually reduced in downstream direction of the housing, and wherein a first flexible sealing ring is arranged on the outer surface of the sleeve, such that the inner surface of the tapered section of the housing is pressed against the outer surface of the sealing ring when the sleeve is in the first position thereof, and such that said first sealing ring only loosely engages the tapered section of the housing when the sleeve is in the second position thereof.

The tapered section of the sleeve or alternatively of the surrounding housing allows the sleeve to slide easily up and down through the valve housing until the sleeve has nearly reached the first position, whereas the surrounding first sealing ring provides a fluid tight seal when the sleeve has reached the first position. Since the sleeve is able to easily slide up and down through the valve housing there is no need to use an additional hydraulic piston as known from U.S. Pat. No. 5,004,007.

In addition to the first sealing ring a second flexible sealing ring may be arranged in the tubular housing downstream of the first sealing ring, which second sealing ring is configured as a stop for the sleeve when the sleeve is moved in the first position thereof.

Said first and second sealing rings may be made of an elastomeric material and define an sealed annular enclosure in which the flapper valve body and seat are arranged when the sleeve is moved in the first position thereof.

The flapper valve body may be equipped with a spring which biases the valve body towards a closed position and wherein a spring is arranged between the tubular valve body and the valve protection sleeve, which biases the valve protection sleeve towards the second position.

The gas lift flow control device may be configured to be retrievably positioned in a substantially vertical position in a side pocket in the production tubing of an oil well, and the spring which biases the valve protection sleeve towards the second position is configured to collapse if the accumulation of the gravity of the valve protection sleeve and forces exerted by the lift gas to the sleeve exceed a predetermined threshold value.

Preferably, the spring is configured to collapse when the lift gas injection pressure has reached a value, which is lower than the lift gas injection pressure during normal oil production.

It is also preferred that the flapper type valve body comprises a tilted face which is dimensioned such that the point of initial contact by the sleeve when moving from the second position to the first position is at the point farthest away from a hinge pin of the flapper type valve body. This results in less strain on the hinge pin, resulting in longer life and reduced failures due to hinge pin stress and strain.

We claim:

1. An apparatus for injecting lift gas into a production conduit of an oil well via one or more downhole gas lift flow control devices comprising:

a tubular valve housing comprising a flow passage having an upstream end which is connected to a lift gas supply conduit and a downstream end which is connected to the interior of the production conduit;

a flapper type valve body which is pivotally connected to the valve housing and is arranged in the flow passage such that if the valve body is pivoted in the open position the valve body is oriented substantially parallel to the flow passage and that if the valve body is pivoted in the closed position the valve body is oriented substantially orthogonal or perpendicular to the flow passage and is pressed against a ring shaped valve seat, thereby blocking passage of fluids through the flow passage;

a valve protection sleeve which is slidably arranged in the flow passage between a first position wherein the sleeve extends through the ring-shaped valve seat, whilst the valve body is pivoted in the open position, thereby protecting the valve seat and valve body against wear by the flux of lift gas or other fluids and a second position wherein the sleeve extends through the section of the flow passage upstream of the valve seat, whilst the valve body is pivoted in the closed position, said sleeve having an upstream end and a downstream end;

a flow restrictor forming part of the valve protection sleeve, which is dimensioned such that the flux of lift gas or other fluids flowing through the flow restrictor creates a pressure difference which induces the sleeve to move towards the first position; and a first seal ring disposed between the sleeve and the housing upstream of the valve seat;

wherein the downstream end of the sleeve includes a tapered section where the outer diameter of the sleeve decreases in the downstream direction, such that the outer surface of the tapered section of the sleeve is pressed against the inner surface of the seal ring when the sleeve is in the first position, thereby providing a fluid tight seal in the annular space between the tapered section of the sleeve and the housing when the sleeve is in the first position and such that said first seal ring only loosely engages the tapered section of the sleeve when the sleeve is in the second position.

2. The apparatus of claim 1, wherein a second flexible sealing ring is arranged in the tubular housing downstream of the first sealing ring, which second sealing ring is configured as a stop for the sleeve when the sleeve is moved into the first position.

3. The apparatus of claim 2, wherein the first and second sealing rings are made of an elastomeric material and define a sealed annular enclosure in which the flapper valve body and seat are arranged when the sleeve is moved in the first position.

4. A method of producing crude oil through a production tubing, wherein crude oil production is enhanced by injecting lift gas into the production tubing by means of the apparatus according to claim 1.

5. A gas lift flow control device for injecting lift gas or other fluid into a production conduit of an oil well, comprising:

a tubular valve housing comprising a flow passage having an upstream end which is configured to be connected to a lift gas supply conduit and a downstream end which is configured to be connected to the interior of the production conduit;

a flapper type valve body which is pivotally connected to the valve housing and is arranged in the flow passage such that if the valve body is pivoted in the open position the valve body is oriented substantially parallel to the flow passage and that if the valve body is pivoted in the closed position the valve body is oriented substantially perpendicular to the flow passage and is pressed against a ring shaped valve seat, thereby blocking passage of lift gas through the flow passage;

a valve protection sleeve which is slidably arranged in the flow passage between a first position wherein the sleeve extends through the ring-shaped valve seat, whilst the valve body is pivoted in the open position, thereby protecting the valve seat and valve body against wear by the flux of lift gas or other fluids and a second position wherein the sleeve extends through the section of the flow passage upstream of the valve seat, whilst the valve body is pivoted in the closed position, said sleeve having an upstream end and a downstream end;

a flow restrictor forming part of the valve protection sleeve, which is dimensioned such that the flux of lift gas flowing through the flow restrictor creates a pressure difference which induces the sleeve to move towards the first position;

a first seal ring disposed between the sleeve and the housing upstream of the valve seat;

wherein the downstream end of the sleeve includes a tapered section where the outer diameter of the sleeve decreases in the downstream direction, such that the outer surface of the tapered section of the sleeve is in the first position, thereby providing a fluid tight seal in the annular space between the tapered section of the sleeve and the housing when the sleeve is in the first position and such that said first seal ring only loosely engages the tapered section of the sleeve when the sleeve is in the second position.

6. The gas lift flow control device claim 5, wherein a second flexible sealing ring is arranged in the tubular housing downstream of the first sealing ring, which second sealing ring is configured as a stop for the sleeve when the sleeve is moved in the first position.

7. The gas lift flow control device of claim 5, wherein the first and second sealing rings are made of an elastomeric material and define an sealed annular enclosure in which the flapper valve body and seat are arranged when the sleeve is moved in the first position.

8. The gas lift flow control device of claim 5, wherein the flapper valve body is equipped with a spring which biases the valve body towards a closed position and wherein a spring is arranged between the tubular valve body and the valve protection sleeve, which biases the valve protection sleeve towards the second position.

9. The gas lift flow control device of claim 8, wherein the device is configured to be retrievably positioned in a substantially vertical position in a side pocket in the production conduit of an oil well, and the spring which biases the valve protection sleeve towards the second position is configured to collapse if the accumulation of the gravity of the valve protection sleeve and forces exerted by the lift gas to the sleeve exceed a predetermined threshold value.

10. The gas lift flow control device of claim 9, wherein the spring is configured to collapse when the lift gas injection pressure has reached a value which is lower than the lift gas injection pressure during normal oil production.

11. The gas lift flow control device of claim 10, wherein the flapper type valve body comprises a tilted face which is dimensioned such that the point of initial contact by the sleeve when moving from the second position to the first position is a the point farthest away from a hinge pin of the flapper type valve body.

12. The gas lift flow control device of claim 5, wherein taper angles of the tapered section of the housing and the sleeve are selected such that the sleeve is centralized within the housing as the flapper type valve body moves to the open position.

* * * * *